US007308789B2

(12) United States Patent
Lee

(10) Patent No.: US 7,308,789 B2
(45) Date of Patent: Dec. 18, 2007

(54) HYDRAULIC CYLINDER SUSPENSION METHOD

(75) Inventor: Jeong Kyu Lee, Changwon (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 733 days.

(21) Appl. No.: 10/878,869

(22) Filed: Jun. 28, 2004

(65) Prior Publication Data

US 2005/0207898 A1 Sep. 22, 2005

(30) Foreign Application Priority Data

Mar. 22, 2004 (KR) ..... 10-2004-0019258

(51) Int. Cl.

| | |
|---|---|
| ***F15B 21/08*** | (2006.01) |
| ***F15B 11/04*** | (2006.01) |
| ***F15B 11/028*** | (2006.01) |
| *E02F 9/22* | (2006.01) |

(52) U.S. Cl. ..... 60/469

(58) Field of Classification Search ..... 60/461, 60/469

See application file for complete search history.

(56) References Cited

U.S. PATENT DOCUMENTS

| | | | | |
|---|---|---|---|---|
| 5,832,730 | A * | 11/1998 | Mizui | 60/469 |
| 6,474,064 | B1 * | 11/2002 | Heyne et al. | 60/469 |
| 6,553,278 | B2 * | 4/2003 | Handroos et al. | 700/213 |
| 7,032,332 | B2 * | 4/2006 | Sharkness et al. | 60/468 |
| 7,104,054 | B1 * | 9/2006 | Dix | 60/469 |

FOREIGN PATENT DOCUMENTS

| | | | |
|---|---|---|---|
| EP | 0 747 797 | | 12/1996 |
| EP | 1 174 384 | | 1/2002 |
| JP | 05 163746 | | 6/1993 |
| JP | 05 321297 | | 12/1993 |
| JP | 08013546 | A * | 1/1996 |
| JP | 09250504 | A * | 9/1997 |

OTHER PUBLICATIONS

Patent Abstracts of Japan of JP 05 163746 dated Jun. 29, 1993.
Patent Abstracts of Japan of JP 05 321297 dated Dec. 7, 1993.

* cited by examiner

*Primary Examiner*—Thomas E. Lazo
(74) *Attorney, Agent, or Firm*—Ladas and Parry LLP

(57) ABSTRACT

The present invention discloses a hydraulic cylinder suspension method for actively controlling shock-induced vibration when a hydraulic cylinder in a construction vehicle makes a sudden stop, the method comprising the steps of: determining whether the hydraulic cylinder makes a sudden stop; receiving a pressure signal; determining an operational direction of the hydraulic cylinder during a sudden stop of the hydraulic cylinder; and supplying hydraulic fluid to large and small chambers of the hydraulic cylinder or returning to a tank.

2 Claims, 4 Drawing Sheets

A : Supply fluid to large chamber and return fluid of small chamber to tank

B : Supply fluid to small chamber and return fluid of large chamber to tank

B : Supply fluid to small chamber and return fluid of large chamber to tank

HYDRAULIC CYLINDER SUSPENSION METHOD

BACKGROUND OF THE INVENTION

1. Field of the Invention

The present invention relates in general to a hydraulic cylinder, and more particularly, to a hydraulic cylinder suspension method for actively controlling vibration that is generated when a hydraulic cylinder such as a boom cylinder in a construction vehicle stops running all of a sudden.

2. Description of the Related Art

In general, a construction vehicle including an excavator is provided with various working equipments such as a boom, arm, and bucket, and is driven by a hydraulic cylinder that is operated by hydraulic fluid from a hydraulic pump. Also, a control valve is installed between the hydraulic pump and the hydraulic cylinder. It is the control valve that controls the hydraulic fluid from the hydraulic pump and supplies it to every hydraulic cylinder. More specifically, to drive the construction vehicle, a driver operates an operation lever, and then a control device controls the control valve, whereby hydraulic pressure, direction and flow of the hydraulic fluid supplied to the hydraulic cylinders are controlled.

The working equipment is usually heavy and massive capable of withstanding overload and rough work environment. Because of its heavy weight, inertia of the working equipment is also large. Thus, when the working equipment is in operation or stops running, it vibrates a lot due to the large inertia. In case of driving a construction vehicle, although an experienced driver can operate the operation lever with great delicacy and skill to move the working equipment gently, a beginner often finds difficulty in handling the operation lever, especially for starting and finishing the operation of the lever because of shock-induced vibration generated by inertia of the working equipment.

Moreover, sometimes drivers tend to move the operation lever quickly to finish work within time. When the operation lever is manipulated fast, the spool in the control valve for supplying hydraulic fluid to the hydraulic cylinder is moved violently. Therefore, vibration is generated due to shock at the start or end of the hydraulic cylinder, and repeatedly generated vibration makes drivers feel more tired.

As aforementioned, the vibration generated at the start or end of the operation of the working equipment adds to the fatigue of the drivers, which not only reduces work efficiency but also shortens lifespan of the vehicle. Thus, there have been a number of attempts to resolve the above problems.

One of generally used techniques for relieving shocks generated from a sudden operation of the working equipment is to use a pressure sensor that senses whether the operation lever starts operating suddenly and if so, a controller controls the control valve by changing an operation signal from the operation lever to proper signal for preventing vibration.

However, the above technique only attempts to control the control valve to prevent the sudden operation of the working equipment by changing the operation signal from the operation lever, and it does not provide a fundamental solution for the actual vibration that is generated when the hydraulic cylinder of the working equipment gets a shock.

SUMMARY OF THE INVENTION

It is, therefore, an object of the present invention to provide a hydraulic cylinder suspension method for actively controlling shock-induced vibration generated when a hydraulic cylinder of a construction vehicle suddenly stops working, whereby work efficiency using the working equipment can be improved and driver fatigue can be reduced.

To achieve the above object, there is provided a hydraulic cylinder suspension method for use in a hydraulic drive system comprised of a hydraulic cylinder driving a working equipment and having a large chamber and a small chamber to which hydraulic fluid from a hydraulic pump is supplied, a control valve allowing the hydraulic fluid in the hydraulic pumps to be supplied to the hydraulic cylinder and returning the hydraulic fluid from the hydraulic cylinder to a tank, an operation lever for generating an operation signal to drive the working equipment, a controller changing the operational signal and generating a control signal for controlling the control valve, a valve drive unit controlling the control valve according to the control signal from the controller, and a pressure detection means mounted on the large chamber of the hydraulic cylinder and detecting operational pressure on the large chamber, the method comprising the steps of: receiving the operation signal of the operation lever and determining whether the hydraulic cylinder makes a sudden stop; receiving a pressure signal from the pressure detection means mounted on the large chamber of the hydraulic cylinder; if the hydraulic cylinder makes the sudden stop, determining whether the hydraulic cylinder is being extended or compressed; and if the hydraulic cylinder makes the sudden stop while the hydraulic cylinder is being extended, supplying the hydraulic fluid to the large chamber of the hydraulic cylinder for a predetermined amount of time starting from a point where the pressure signal reached a minimum for the first time, and returning the hydraulic fluid in the small chamber to the tank, while supplying the hydraulic fluid to the small chamber of the hydraulic cylinder for a predetermined amount of time starting from a point where the pressure signal reached a maximum for the first time, and returning the hydraulic fluid in the large chamber to the tank; if the hydraulic cylinder makes the sudden stop while the hydraulic cylinder is being compressed, supplying the hydraulic fluid to the small chamber of the hydraulic cylinder for a predetermined amount of time starting from a point where the pressure signal reached a maximum for the first time, and returning the hydraulic fluid in the large chamber to the tank.

Preferably, to optimally control vibration supply time of hydraulic fluid to the large chamber and the small chamber is within a range of 1/12 to 1/4 of a period of the pressure signal starting from a maximum/minimum point where the pressure signal reaches for the first time, and when the hydraulic fluid is supplied to the large and small chambers, opening are of the control valve is within a range of 1/4 to 3/4 of a maximum opening.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

Figure 1:
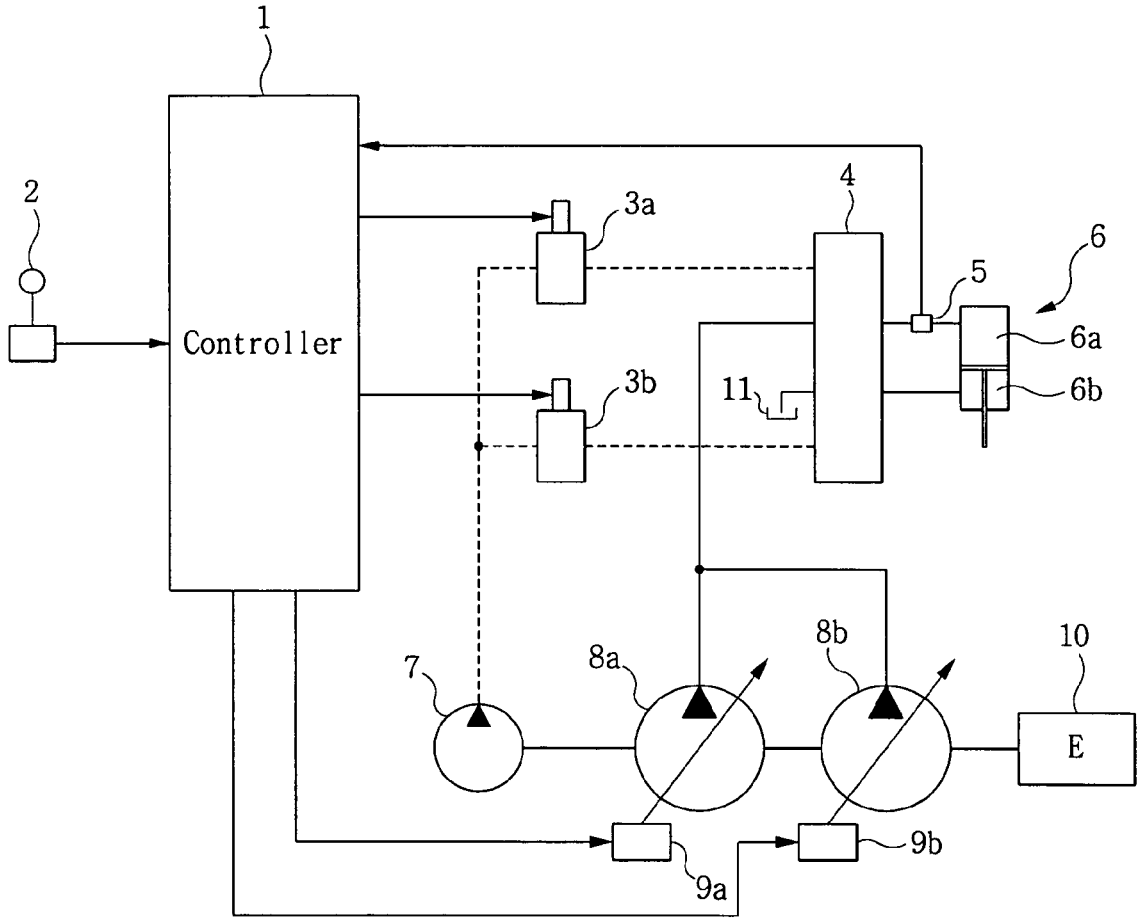
FIG. 1 is a schematic diagram of a hydraulic system to which a hydraulic cylinder suspension method according to one embodiment of the present invention is applied.

FIG. 1 is a schematic diagram of a hydraulic system to which a hydraulic cylinder suspension method according to one embodiment of the present invention is applied.

The hydraulic system, to which a hydraulic cylinder suspension method is applied, includes hydraulic pumps 8*a*, 8*b* driven by an engine 10; a boom cylinder 6 for driving a boom (not shown), one of working equipments, by using hydraulic fluid from the hydraulic pumps 8*a*, 8*b*; a control valve 4 for supplying hydraulic fluid in the hydraulic pumps 8*a*, 8*b* to the boom cylinder 6; an operation lever 2 for generating an operation signal for driving an working equipment (not shown); a controller 1 for changing the operational signal to a control signal; and valve drivers 3*a* and 3*b* for controlling the control valve 4 according to the control signal from the controller 1.

A generally known hydraulic cylinder is used as the boom cylinder 6. The boom cylinder 6 is divided into a large chamber 6*a* and a small chamber 6*b*. When the boom cylinder 6 is extended, the control valve 4 allows the hydraulic fluid from the hydraulic pumps 8*a*, 8*b* to be supplied to the large chamber 6*a*, while the hydraulic fluid in the small chamber 6*b* flows back to a tank 11.

On the other hand, when the boom cylinder 6 is compressed, the control valve 4 allows the hydraulic fluid from the hydraulic pumps 8*a*, 8*b* to be supplied to the small chamber 6*b*, while the hydraulic fluid in the large chamber 6*a* flows back to the tank 11. Also, a pressure detection means 5 is mounted on the large chamber 6*a* of the boom cylinder 6. The pressure detection means 5 detects pressure operating on the large chamber 6*a* of the boom cylinder 6, and a detected pressure signal is transferred to the controller 1.

The valve drivers 3*a* and 3*b* are connected to a pilot pump 7 and create a pilot pressure, according to the control signal from the controller 1. Thusly created pilot pressure is provided to the control valve 4 to be used in controlling the operation of the control valve 4. Reference numerals 9*a* and 9*ba* in FIG. 1 denote pump flow control means.

Based on the above-described structure, the following will now explain the operation of a hydraulic drive system to which the hydraulic cylinder suspension method is applied.

The operation lever 2 is a device generating an operation signal for driving working equipment (not shown). The operation signal of the operation lever 2 is inputted to the controller 1 and is changed, by the controller 1, to the control signal for driving the valve drivers 3*a* and 3*b*. The controller 1 outputs the control signal for operating the valve drivers 3*a* and 3*b* according to the inputted operational signal from the operation lever 2, thereby controlling the operation of the control valve 4 and causing the boom cylinder 6 to run.

The controller 1 determines, on the basis of the operation signal from the operation lever 2, whether the boom cylinder 6 has been suddenly stopped. If it turns out that the boom cylinder 6 made a sudden stop by the sudden operation of the operation lever 2, the controller 1 actively controls the vibration generated in the boom cylinder 6. As described above, a pressure signal, detected by the pressure detection means 5, indicating pressure state of the large chamber 6*a* of the boom cylinder 6 is also sent to the controller 1, so the controller 1 is capable of performing active suspension work in response to the pressure state in the boom cylinder.

In the case the boom cylinder 6 makes a sudden stop by the sudden operation of the operation lever 2, the controller 1 determines whether the boom cylinder 6 made the sudden stop while a boom (not shown) was ascending or while a boom (not shown) was descending, and drives the valve drivers 3*a* and 3*b* appropriate for each case, thereby controlling the vibration.

More specifically, the case where the boom cylinder 6 made the sudden stop while the boom was ascending indicates that the boom cylinder 6 was suddenly stopped while the boom cylinder 6 was extending. At this time, the controller 1 allows the hydraulic fluid to be supplied to the large chamber 6*a* for a certain amount of time starting from a point where the pressure signal has reached a minimum for the first time, and also allows the hydraulic fluid in the small chamber 6*a* to flow back to the tank 11. Moreover, the controller 1 allows the hydraulic fluid to be supplied to the small chamber 6*b* for a certain amount of time starting from a point where the pressure signal has reached a maximum for the first time, and also allows the hydraulic fluid in the large chamber 6*a* to flow back to the tank 11. In this manner, the vibration generated in the boom cylinder 6 is actively controlled.

On the other hand, the case where the boom cylinder 6 made the sudden stop while the boom was descending indicates that the boom cylinder 6 was suddenly stopped while the boom cylinder 6 was being compressed. At this time, the controller 1 allows the hydraulic fluid to be supplied to the small chamber 6*b* for a certain amount of time starting from a point where the pressure signal has reached a maximum for the first time, and also allows the hydraulic fluid in the large chamber 6*b* to flow back to the tank 11.

Figure 2:
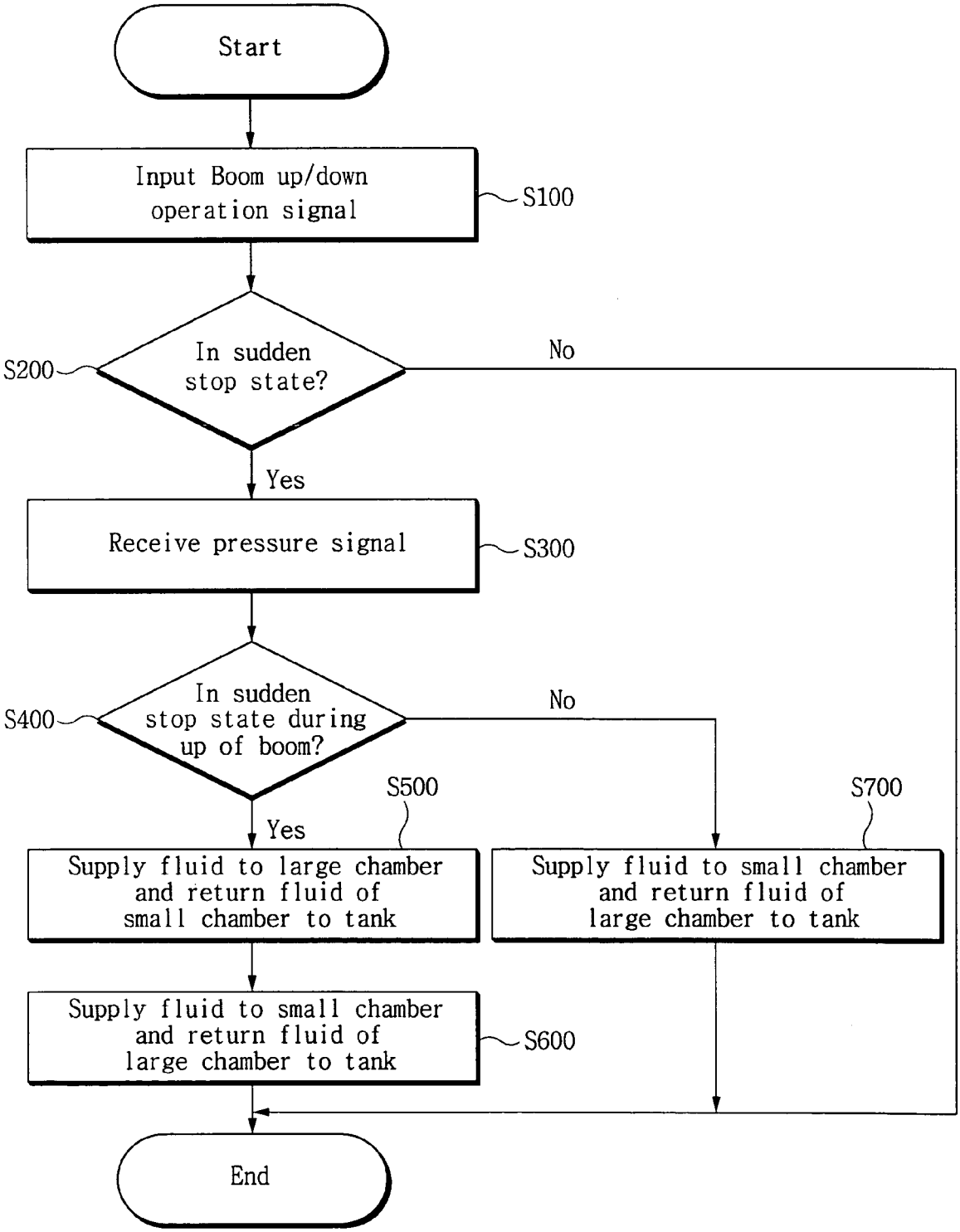
FIG. 2 is a flow chart describing a control flow of a hydraulic cylinder suspension method according to one embodiment of the present invention.
Figure 3:
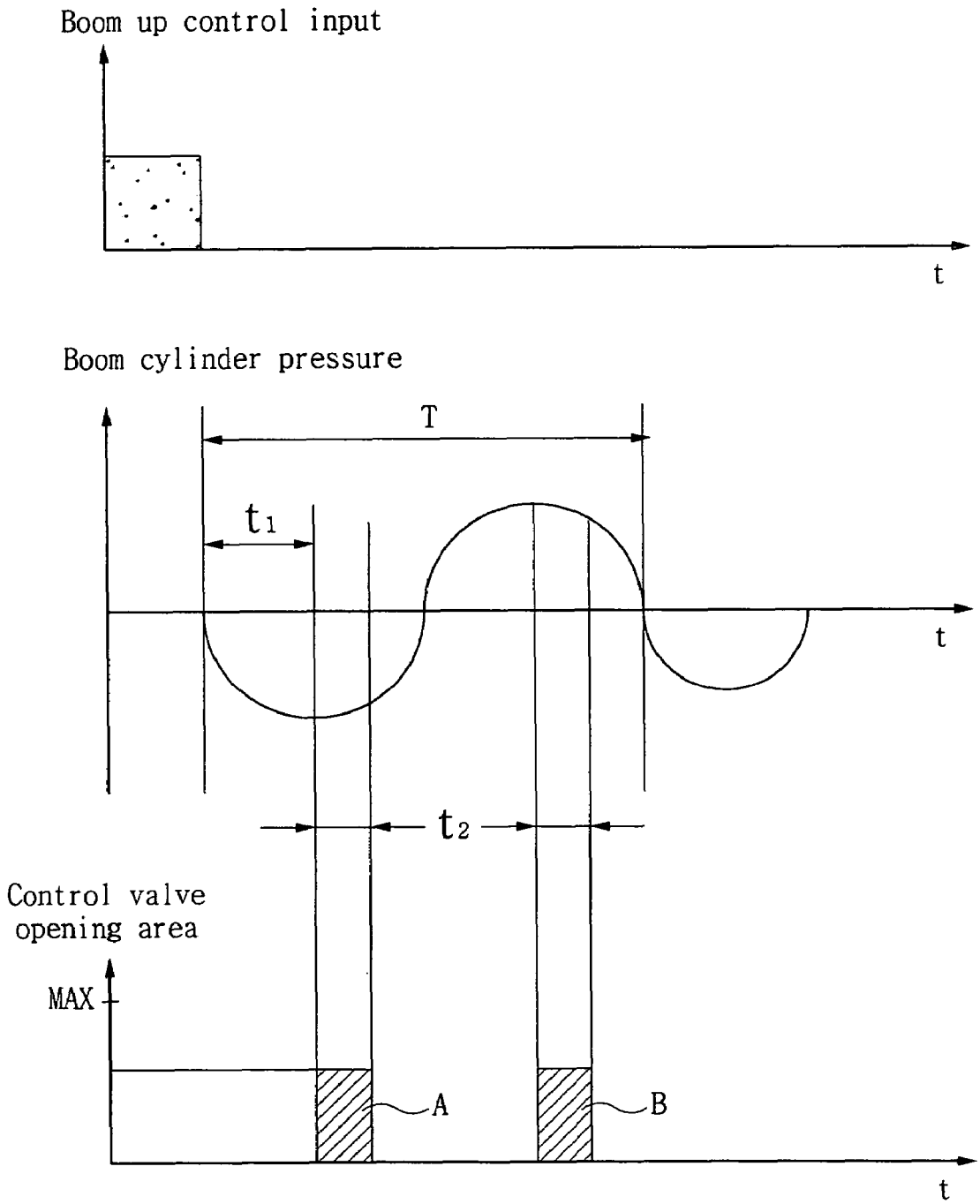
FIG. 3 graphically illustrates a relation between hydraulic fluid supply time and boom up control input when a boom cylinder makes a sudden stop, in relation to a hydraulic cylinder suspension method according to one embodiment of the present invention.

FIG. 2 is a flow chart describing a control flow of the hydraulic cylinder suspension method according to one embodiment of the present invention; FIG. 3 graphically illustrates a relation between hydraulic fluid supply time and boom ascending control input when the boom cylinder makes a sudden stop, in relation to the hydraulic cylinder suspension method according to one embodiment of the present invention; and FIG. 4 graphically illustrates a relation between hydraulic fluid supply time and boom descending control input when the boom cylinder makes a sudden stop, in relation to the hydraulic cylinder suspension method according to one embodiment of the present invention.

The hydraulic cylinder suspension method according to one embodiment of the present invention largely includes sudden stop determination step (S100, S200); pressure signal receiving step (S300); operational direction determination step (S400); and hydraulic fluid supply step (S500, S600, and S700). Here, the hydraulic fluid supply step is associated with two cases: first, the boom cylinder 6 makes the sudden stop while it was being extended (S500, S600), and second, the boom cylinder 6 makes the sudden stop while it was being compressed (S700).

In the sudden stop determination step (S100, S200), the controller receives the operation signal from the operation lever 2 and determines whether the boom cylinder 6 made a sudden stop. If the operation signal of the operation lever 2 corresponds to a sudden operation signal, the controller 1 determines that the boom cylinder 6 has suddenly stopped and thus, performs the following steps for actively controlling the vibration generated in the boom cylinder 6.

In the pressure signal receiving step (S300), the controller 1 receives the pressure signal from the pressure detection means 5 mounted on the large chamber 6*a* of the boom cylinder 6. Here, the controller 1 actively controls the vibration, in response to a pressure change generated in the large chamber 6*a* or based on the received pressure signal.

In the operational direction determination step (S400), the controller 1 determines the movement direction of the boom cylinder 6 when the boom cylinder 6 made a sudden stop, so this is actually a very important step. That is, the controller 1 selects a chamber to which hydraulic fluid should be supplied in order to offset the shock-induced vibration generated by the sudden stop of the boom cylinder 6, according to whether the boom cylinder 6 has been suddenly stopped while the boom was ascending (i.e. while the boom cylinder 6 was being extended) or the boom cylinder has been suddenly stopped while the boom was descending (i.e. while the boom cylinder 6 was being compressed).

As aforementioned, the hydraulic fluid supply step (S500, S600, and S700) is associated with two cases: first, the boom cylinder 6 makes the sudden stop while the boom was being extended (S500, S600), and second, the boom cylinder 6 makes the sudden stop while it was being compressed (S700).

When the boom cylinder 6 makes the sudden stop while it was being extended, hydraulic fluid is supplied to the large chamber 6*a* (S500) and then to the small chamber 6*b*(S600).

In particular, when the boom cylinder 6 makes the sudden stop while it was being extended, the pressure inside the boom cylinder 6 is fluctuated and vibration is generated by the shock.

Referring to FIG. 3, 'T' denotes a period of fluctuation of the pressure signal. The controller 1 allows the hydraulic fluid to be supplied to the large chamber 6*a* for a certain amount of time t2 starting from a point t1 where the pressure signal has reached a minimum for the first time, and also allows the hydraulic fluid in the small chamber 6*a* to flow back to the tank 11. Afterwards, the controller 1 allows the hydraulic fluid to be supplied to the small chamber 6*b* for a certain amount of time t2 starting from a point where the pressure signal has reached a maximum for the first time, and also allows the hydraulic fluid in the large chamber 6*a* to flow back to the tank 11. In this manner, the vibration generated in the boom cylinder 6 is actively controlled.

On the other hand, when the boom cylinder 6 makes a sudden stop while it was being compressed, the controller 1 allows the hydraulic fluid to be supplied to the small chamber 6*b* (S700). That is, the controller 1 allows the hydraulic fluid to be supplied to the small chamber 6*b* for a certain amount of time t2 starting from a point where the pressure signal has reached a maximum for the first time, and also allows the hydraulic fluid in the large chamber 6*b* to flow back to the tank 11, thereby actively controlling the vibration generated in the boom cylinder 6.

Preferably, the supply time of the hydraulic fluid to the large and small chambers 6*a* and 6*b* falls within the range of 1/12 to 1/4 of the period of the pressure signal starting from the maximum/minimum point where the pressure signal reached for the first time. The range is obtained after carrying out experimental researches on the boom cylinder and vibration characteristics of the system, by which the vibration can be optimally controlled.

Figure 4:
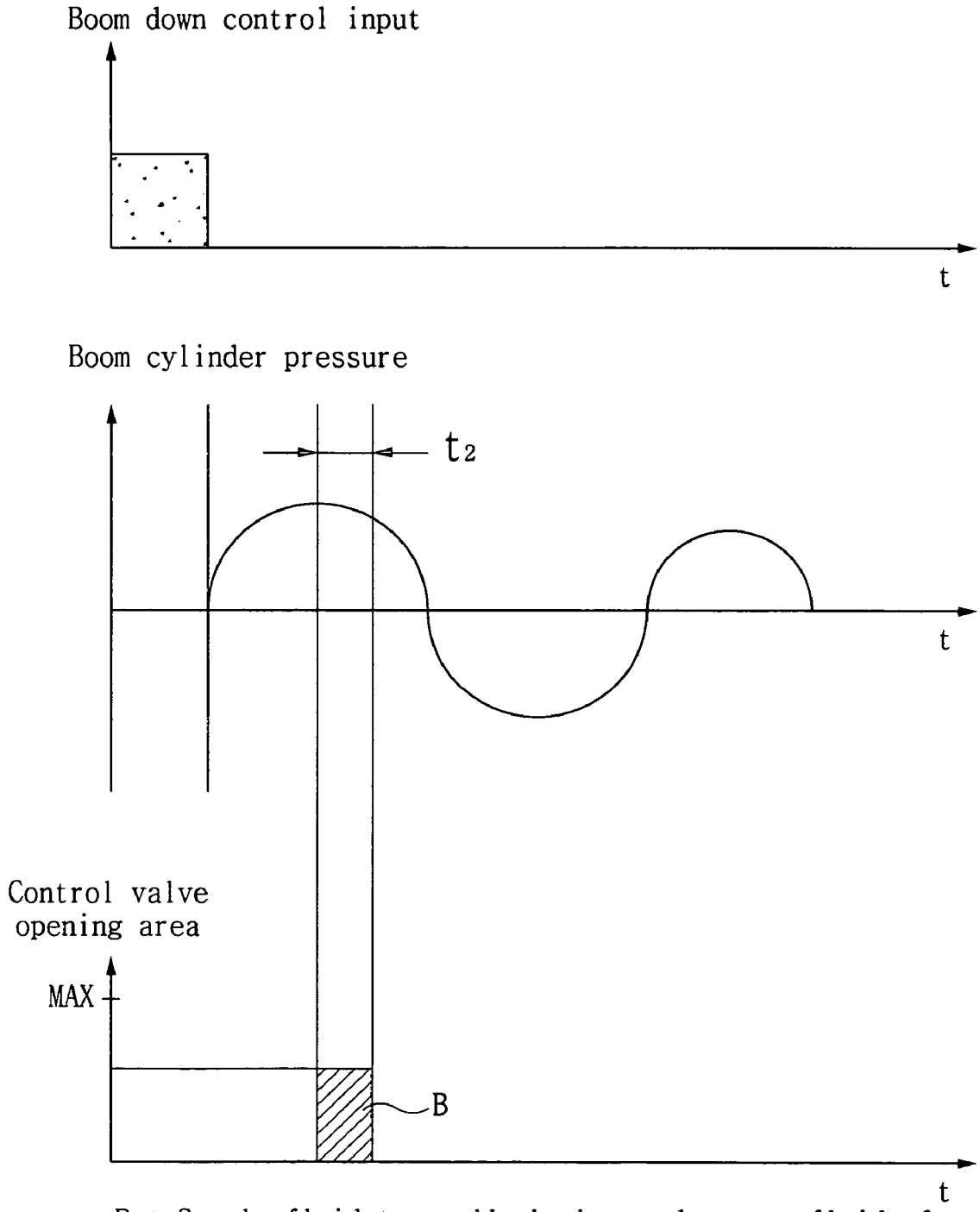
FIG. 4 graphically illustrates a relation between hydraulic fluid supply time and boom down control input when a boom cylinder makes a sudden stop, in relation to a hydraulic cylinder suspension method according to one embodiment of the present invention.

Also, as shown in FIG. 3 and FIG. 4, when hydraulic fluid is supplied to the large and small chambers 6*a* and 6*b*, the opening area of control valve 4 is preferably within a range of 1/4 to 3/4 of its maximum opening. Again, this range is obtained from experiments to find a value at which the vibration of the boom cylinder 6 is optimally controlled.

In conclusion, according to the hydraulic cylinder suspension method of the present invention, the shock-induced vibration caused by the sudden stop of the hydraulic cylinder in a construction vehicle can be actively controlled and as a result of this, endurance of vehicle is improved, work efficiency using working equipment is improved, and fatigue to the driver is much reduced.

While the invention has been described in conjunction with various embodiments, they are illustrative only. Accordingly, many alternative, modifications and variations will be apparent to persons skilled in the art in light of the foregoing detailed description. The foregoing description is intended to embrace all such alternatives and variations falling with the spirit and broad scope of the appended claims.

What is claimed is:

1. A hydraulic cylinder suspension method for use in a hydraulic drive system comprised of a hydraulic cylinder driving a working equipment and having a large chamber and a small chamber to which hydraulic fluid from a hydraulic pump is supplied, a control valve allowing the hydraulic fluid in the hydraulic pumps to be supplied to the hydraulic cylinder and returning the hydraulic fluid from the hydraulic cylinder to a tank, an operation lever for generating an operation signal to drive the working equipment, a controller changing the operational signal and generating a control signal for controlling the control valve, a valve drive unit controlling the control valve according to the control signal from the controller, and a pressure detection means mounted on the large chamber of the hydraulic cylinder and detecting operational pressure on the large chamber, the method comprising the steps of:

receiving the operation signal of the operation lever and determining whether the hydraulic cylinder makes a sudden stop;

receiving a pressure signal from the pressure detection means mounted on the large chamber of the hydraulic cylinder;

if the hydraulic cylinder makes the sudden stop, determining whether the hydraulic cylinder is being extended or compressed; and if the hydraulic cylinder makes the sudden stop while the hydraulic cylinder is being extended, supplying the hydraulic fluid to the large chamber of the hydraulic cylinder for a predetermined amount of time starting from a point where the pressure signal reached a minimum for the first time, and returning the hydraulic fluid in the small chamber to the tank, while supplying the hydraulic fluid to the small chamber of the hydraulic cylinder for a predetermined amount of time starting from a point where the pressure signal reached a maximum for the first time, and returning the hydraulic fluid in the large chamber to the tank; if the hydraulic cylinder makes the sudden stop while the hydraulic cylinder is being compressed, supplying the hydraulic fluid to the small chamber of the hydraulic cylinder for a predetermined amount of time starting from a point where the pressure signal reached a maximum for the first time, and returning the hydraulic fluid in the large chamber to the tank.

2. The method according to claim 1, wherein to optimally control vibration, supply time of hydraulic fluid to the large chamber and the small chamber is within a range of 1/12 to 1/4 of a period of the pressure signal starting from a maximum/minimum point where the pressure signal reaches for the first time, and when the hydraulic fluid is supplied to the large and small chambers, opening area of the control valve is within a range of 1/4 to 3/4 of a maximum opening.

* * * * *